United States Patent [19]

Haase et al.

[11] 4,301,509

[45] Nov. 17, 1981

[54] METHOD FOR COOKING MEAT OR POULTRY IN THERMAL OVEN

[75] Inventors: Michael A. Haase, Euclid, Ohio; Edward B. Miller, West Warwick, R.I.; Charles W. Eichelberger, Schenectady, N.Y.; Scott E. Cutler, Niskayuna, N.Y.; Robert J. Wojnarowski, Clifton Park, N.Y.

[73] Assignee: General Electric Company, Schenectady, N.Y.

[21] Appl. No.: 93,685

[22] Filed: Nov. 13, 1979

[51] Int. Cl.[3] ..... G06F 15/20; H05B 1/02

[52] U.S. Cl. ..... 364/557; 219/494; 364/400

[58] Field of Search ..... 364/400, 557, 300; 219/391, 413, 490, 494; 126/1 R, 19 R, 275 E

[56] References Cited

U.S. PATENT DOCUMENTS

| | | | |
|---|---|---|---|
| 3,761,690 | 9/1973 | Sayles et al. | 364/557 |
| 3,845,275 | 10/1974 | Branson | 219/490 |
| 4,009,359 | 2/1977 | Tallmadge et al. | 364/557 |
| 4,054,778 | 10/1977 | Wollich | 219/413 |
| 4,197,581 | 4/1980 | Watrous et al. | 219/494 |

FOREIGN PATENT DOCUMENTS

| | | | |
|---|---|---|---|
| 2011677 | 7/1979 | United Kingdom | 364/400 |

*Primary Examiner*—Errol A. Krass
*Attorney, Agent, or Firm*—Geoffrey H. Krauss; James C. Davis; Marvin Snyder

[57] ABSTRACT

Meat or poultry is cooked automatically in a thermal oven to a desired degree of doneness by a chosen time. The temperature of the meat or poultry is monitored, and linear extrapolations are made therefrom. These extrapolations are compared to the course the cooking should follow, and the oven temperature is automatically varied to correct deviations from the ideal course.

17 Claims, 10 Drawing Figures

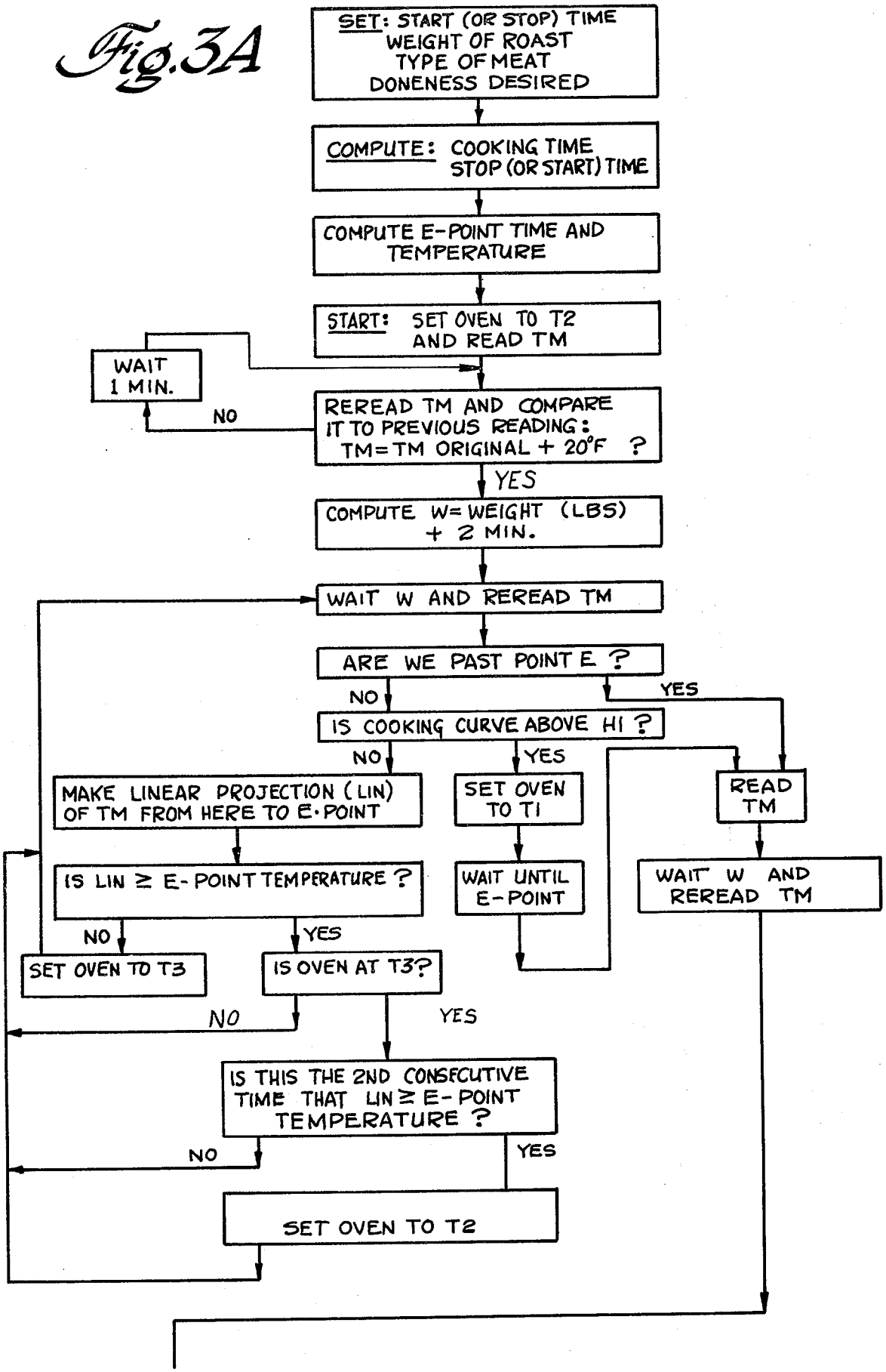
Fig. 3A
SET: START (OR STOP) TIME
WEIGHT OF ROAST
TYPE OF MEAT
DONENESS DESIRED
COMPUTE: COOKING TIME
STOP (OR START) TIME
COMPUTE E-POINT TIME AND TEMPERATURE
START: SET OVEN TO T2 AND READ TM
WAIT 1 MIN.
NO
REREAD TM AND COMPARE IT TO PREVIOUS READING: TM=TM ORIGINAL + 20°F ?
YES
COMPUTE W=WEIGHT (LBS) + 2 MIN.
WAIT W AND REREAD TM
ARE WE PAST POINT E ?
NO
YES
IS COOKING CURVE ABOVE HI ?
NO
YES
MAKE LINEAR PROJECTION (LIN) OF TM FROM HERE TO E-POINT
SET OVEN TO TI
READ TM
IS LIN ≥ E-POINT TEMPERATURE ?
WAIT UNTIL E-POINT
WAIT W AND REREAD TM
NO
YES
SET OVEN TO T3
IS OVEN AT T3?
NO
YES
IS THIS THE 2ND CONSECUTIVE TIME THAT LIN ≥ E-POINT TEMPERATURE ?
NO
YES
SET OVEN TO T2

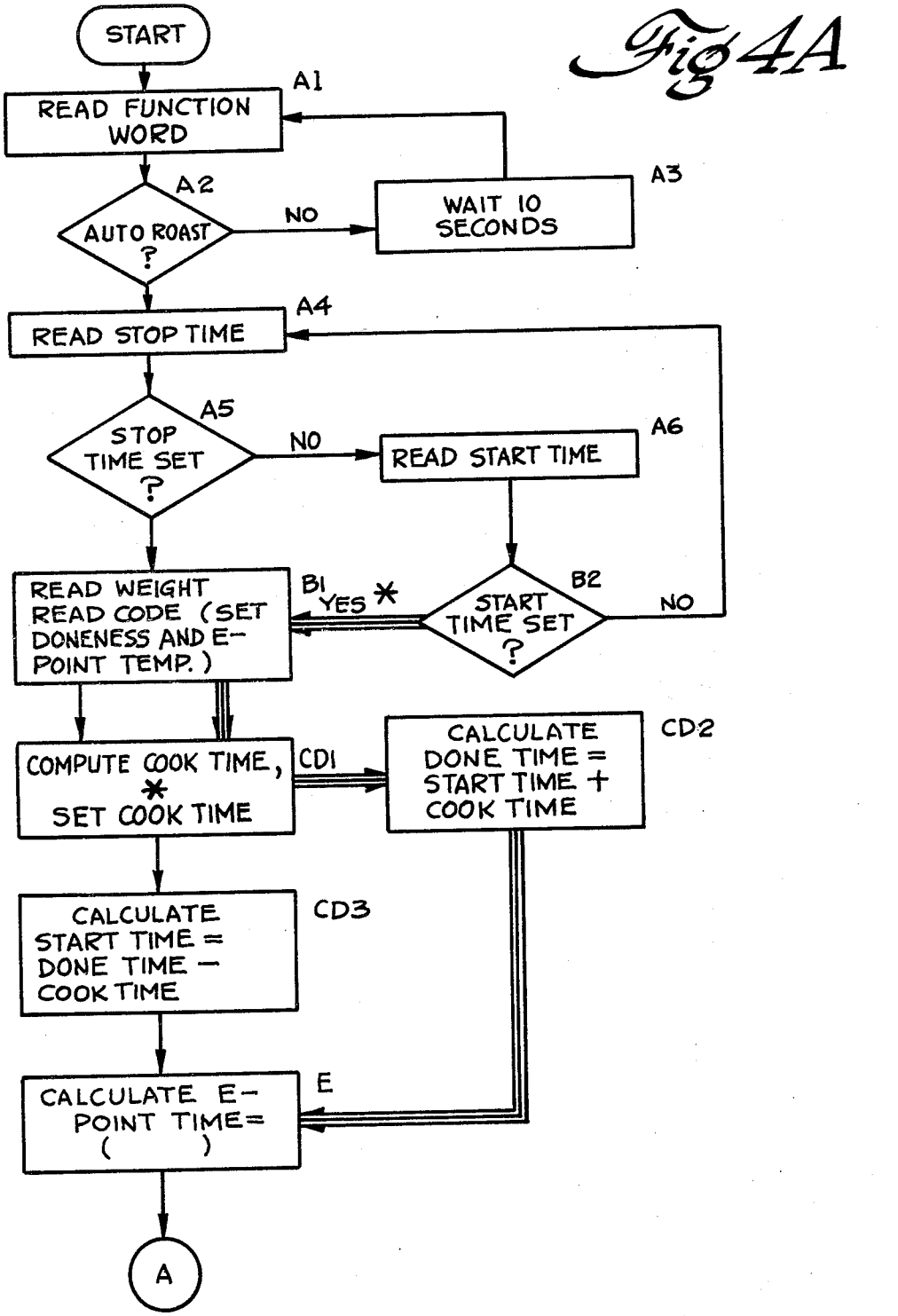
Fig 4A
START
READ FUNCTION WORD
A1
A2
AUTO ROAST ?
NO
WAIT 10 SECONDS
A3
READ STOP TIME
A4
A5
STOP TIME SET ?
NO
READ START TIME
A6
READ WEIGHT READ CODE (SET DONENESS AND E-POINT TEMP.)
B1
YES *
B2
START TIME SET ?
NO
COMPUTE COOK TIME, * SET COOK TIME
CD1
CALCULATE DONE TIME = START TIME + COOK TIME
CD2
CALCULATE START TIME = DONE TIME − COOK TIME
CD3
CALCULATE E-POINT TIME= ( )
E
A
* IF START TIME SET FOLLOW THE LINE IN THE FLOW CHART

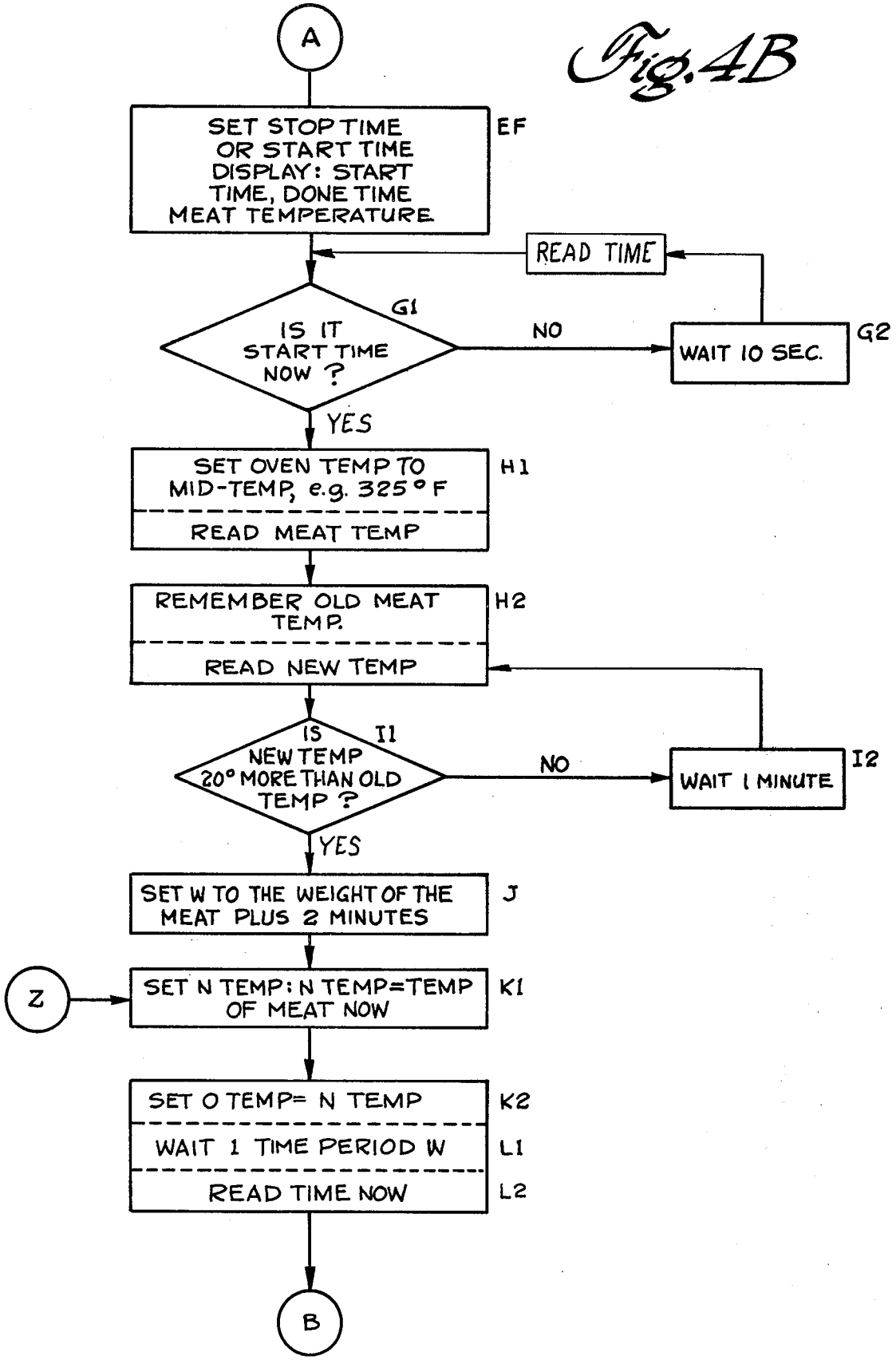
Fig. 4B
A
SET STOP TIME OR START TIME DISPLAY: START TIME, DONE TIME MEAT TEMPERATURE
EF
READ TIME
IS IT START TIME NOW ?
G1
NO
WAIT 10 SEC.
G2
YES
SET OVEN TEMP TO MID-TEMP, e.g. 325° F
READ MEAT TEMP
H1
REMEMBER OLD MEAT TEMP.
READ NEW TEMP
H2
IS NEW TEMP 20° MORE THAN OLD TEMP ?
I1
NO
WAIT 1 MINUTE
I2
YES
SET W TO THE WEIGHT OF THE MEAT PLUS 2 MINUTES
J
Z
SET N TEMP: N TEMP=TEMP OF MEAT NOW
K1
SET O TEMP= N TEMP
K2
WAIT 1 TIME PERIOD W
L1
READ TIME NOW
L2
B B
L3
ARE WE PAST E-TIME ?
YES
C
NO
M1
ARE WE ABOVE H-LINE ?
YES
SET OVEN TEMP TO LOW TEMP, eg. 200°F
M2
WAIT TILL E-POINT TIME
M3
C
NO
MAKE LINEAR PROJ. FROM HERE TO E-POINT TIME; EQUATION (1)
N1
N2
IS LIN PROJ. > E-POINT TEMP ?
NO
TURN OVEN TEMP UP TO HI-TEMP e.g. 375 ° F
N3
Z
YES
O1
IS OVEN AT HI TEMP, eg. 375° ?
NO
Z
YES
O2
IS THIS 2ND HI PROJ. ?
NO
COUNT THIS PROJECTION
O3
Z
YES
SET OVEN TEMP TO MID TEMP, e.g. 325°F
O4
Z C
SET COUNT = O
READ MEAT TEMP
AND SET IT TO
O TEMP
P
WAIT 1 TIME
PERIOD W
Q1
READ TIME +
TEMP. SET N TEMP
Q2
X
MAKE LIN PROJ.;
EQUATION (2)
R1
IS
LIN PROJ >
D TEMP ?
R2
NO
SET OVEN TEMP
TO MID TEMP
(325°F)
R3
E
YES
ARE WE
ABOVE THE H-LINE
?
V2
NO
SET OVEN TEMP
TO HI-TEMP
(375°F)
V3
IS LIN PROJ
≥ O PROJ
?
T1
NO
W
YES
IS OVEN
AT LO TEMP ?
(200°F)
V1
NO
SET OVEN TEMP
TO LO TEMP
(200°F)
T2
YES
E
SET O TEMP ← N
TEMP
O PROJ ← N PROJ.
W
WAIT 1 TIME PERIOD
X
D

METHOD FOR COOKING MEAT OR POULTRY IN THERMAL OVEN

BACKGROUND OF THE INVENTION

This invention relates generally to methods for cooking meat automatically, and more particularly to methods for cooking meat in a thermal oven automatically to a desired degree of doneness and finishing exactly at a selected time, by controlling the temperature of the oven being used to cook the meat.

It is conventional to roast meat automatically by cooking for a length of time selected by the cook. If the cook errs in estimating the weight of the roast, however, the meat will be under- or overcooked. Other variations in the meat (fat content, thickness) affect the optimum cooking time but are difficult to allow for accurately in setting the cooking time.

According to another well-known method, the cook selects the temperature the interior of the meat will have when the desired degree of doneness is reached. The oven automatically turns off when the meat reaches the selected temperature. Assuming that the cook knows the correct internal meat temperature for a given meat and a given doneness, the meat can be cooked as desired. The problem is that variations in the thickness and fat content of the roast cause variations in the cooking time required, as a result of which the cook can not predict accurately when the meat will be done.

A third well-known method, suitable for use only with microwave ovens, is to cook the meat to the desired doneness and then to reduce the rate of energy input to a meat to a level just sufficient to keep the meat at the desired temperature, without cooking it further. In this method, the doneness of the meat is measured by its internal temperature. This method is inherently inapplicable to thermal ovens.

SUMMARY OF THE INVENTION

The principal object of the present invention is to provide a method for cooking meat automatically to the desired doneness, and finishing exactly at a pre-selected time.

Another object is to provide such a method that will satisfactorily compensate for large variations in the consistency of the meat and that is highly tolerant of error in the cook's estimate of the roast weight.

According to the method of the invention, the cooking time of the meat is divided into three parts: a warm-up period; a linear period, during which the internal temperature of the meat increases approximately linearly with time; and an end period. The meat's internal temperature is monitored, and during the linear and end periods it is compared to a pre-determined standard that is a function of cooking time elapsed, of the type of meat and of the weight of the roast. Whenever it is cooking too fast or too slowly, the oven temperature is lowered or raised. The compensation is of an amount calculated to ensure that by the cessation of the end period, the meat will be within a certain number of degrees of the desired final temperature. During the end period, the meat temperature increases more gradually than in the linear period, "coasting" to the desired value at or slightly before the set finishing time. In addition, it is possible to sear the exterior of the meat during this period.

In order to simplify the cooking process, only three oven temperatures are used. The three temperatures chosen depend on the meat. For example, the temperatures used with beef are 200° F., 325° F., and 375° F. 375° F. appears to be the highest temperature that can be used conveniently and safely for cooking meat without running the risk of setting the grease in the oven on fire. For cooking poultry, however, higher temperatures can be used.

BRIEF DESCRIPTION OF THE FIGURES

The embodiment described and illustrated in the following is by way of illustration only and does not in any way limit the scope of the invention.

FIGS. 3A–3B are flow-charts indicating the steps of the method of the present invention; and FIGS. 4A–4F illustrate a flow-chart showing the steps of the method of the invention as they may be carried out in the preferred manner, i.e. by means of a programmed microprocessor.

DETAILED DESCRIPTION OF THE INVENTION

Figure 1:
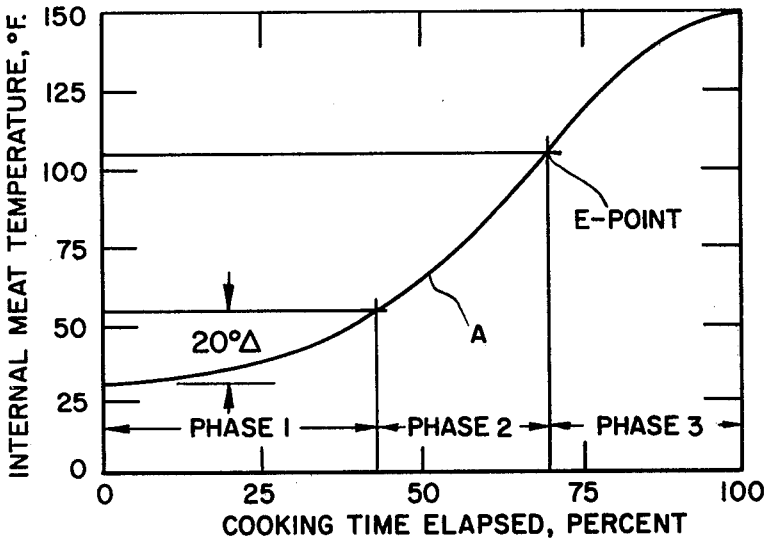
FIG. 1 is a graph of meat temperature versus cooking time elapsed, showing the division of the process into three phases.

As stated above in the summary of the invention and as shown in FIG. 1, the cooking process is divided into three phases. During a large portion of the cooking process, the interior temperature of the meat increases approximately linearly with cooking time. This period is denoted as the linear period, and is the second of the three phases of the cooking process. The warm-up period, which is phase one of the process, is the time before the beginning of the linear period. The end phase, phase three, comprises the remainder of the cooking process. It has been found that the linear phase begins when the interior temperature of the meat has risen approximately twenty Fahrenheit degrees above its original temperature. The cooking proceeds during the first phase in a highly variable fashion dependent upon the pecularities of the piece of meat being cooked. For this reason, no action is taken during this phase other than normal cooking.

For the purposes of the present invention, the linear phase is defined as starting at whatever time the temperature of the meat reaches twenty Fahrenheit degrees above its original temperature and ending after seventy percent of the total cooking time has elapsed. It has been found that during the linear period the rate of cooking as measured by the interior temperature of the roast remains fairly constant. Because of this fact it is possible to measure the interior temperature at two different times during this phase and to make a linear projection of the interior temperature of the meat at the end of the linear phase. This allows us to determine whether the meat is cooking too fast or too slowly. Depending on the projection, the oven temperature can be raised or lowered.

Figure 2:
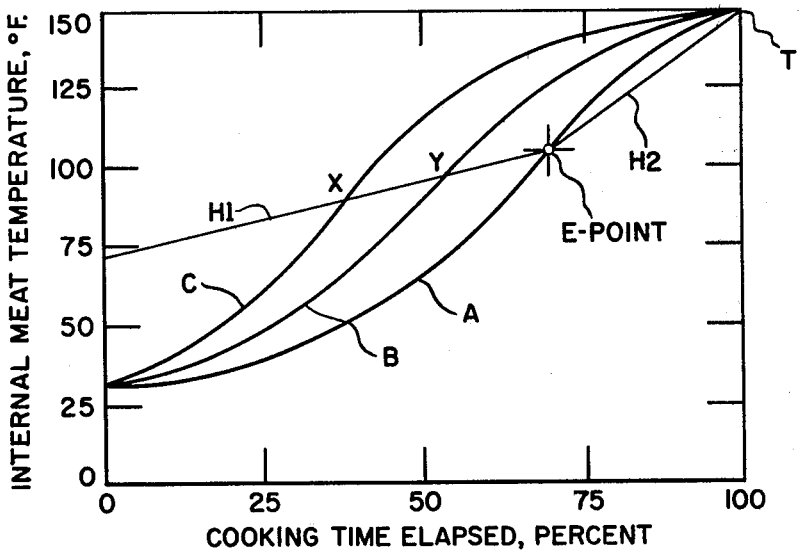
FIG. 2 is a graph similar to that of FIG. 1, showing the E-point and the H-lines (defined below), which are the standards by which the progress of the cooking of a given roast is increased, and showing several possible cooking curves for a roast.

The standards according to which the cooking speed of the meat is judged either too fast or too slow during the linear phase are shown graphically in FIG. 2 as point E and line H1. Point E is a point through which the ideal cooking curve of a roast will pass. If the roast attains the temperature corresponding to point E at the time corresponding to point E and the oven is then turned down relatively low, the roast will reach the desired internal temperature at the desired time. Point E was empirically found to correspond to a temperature some 35–45 Fahrenheit degrees below the desired done temperature and to the lapse of 70 percent of the cooking time.

It has been found that the results are improved significantly if the difference between the temperature corresponding to point E and the target temperature is varied depending on the target temperature. For target temperatures below 140° F., it has been found that the optimum temperature at point E is 45 Fahrenheit degrees below the target temperature; for target temperatures 160° Fahrenheit or above, the optimum difference is 35 Fahrenheit degrees; and for other target temperatures the optimum difference is 40 Fahrenheit degrees.

Line H1 is the line having a slope of 1 Fahrenheit degree per four minutes and passing through point E. It has been found that if the meat is cooking too fast, as illustrated by the examples of curves B and C in FIG. 2, then if the oven temperature is lowered sufficiently at the time corresponding to the intersection of the cooking curve with the line H1 (points X and Y), the amount by which the temperature of the meat must yet rise to attain the done temperature is such as to ensure that the meat will reach the done temperature at the appointed time. It is accordingly unnecessary to turn down the oven temperature when the linear projection indicates that the meat is cooking too fast, until the cooking curve reaches line H1. It is necessary however, to increase cooking temperature prior to this time if a projection of the meat temperature at the time corresponding to point E (this projection is described infra) is too low. In such a case, the cooking temperature is raised until further projections indicate that the meat temperature at point E will be satisfactory or until the line H1 is reached.

The final phase consists of the last thirty percent of the cooking time. In this phase the slope of the cooking curve falls from its maximum value, which is normally reached when the cooking curve crosses the line H1 during the linear phase, to a final approach value, and any final corrections necessary to ensure that the proper interior meat temperature will in fact be attained are performed. During this phase the oven temperature is normally set to the lowest of three settings used in the cooking process for a given type of meat.

During the final phase the rate of change of the cooking curve, i.e. the rate of deceleration of the cooking speed, is monitored. If the deceleration is too rapid, the oven will be turned up from its lowest setting to an intermediate setting until the rate of deceleration has decreased acceptably, after which the oven temperature may be turned back down. Similarly, if the final approach slope is below the expected value, the oven temperature is turned up to its intermediate value. If at any time during the end phase the cooking curve falls below line H2 (see FIG. 2), the oven temperature is turned up to the highest of the three settings used for the type of meat being cooked. Line H2 is the line segment connecting point E and the target point T.

In order to make the roast more appealing, it is possible to sear it during the last few minutes of the end phase. During the searing, the temperature of the oven is turned to its highest value. The time required for searing has been found to be a number of minutes equal to 7 plus the weight of the roast in pounds.

Figure 3B:
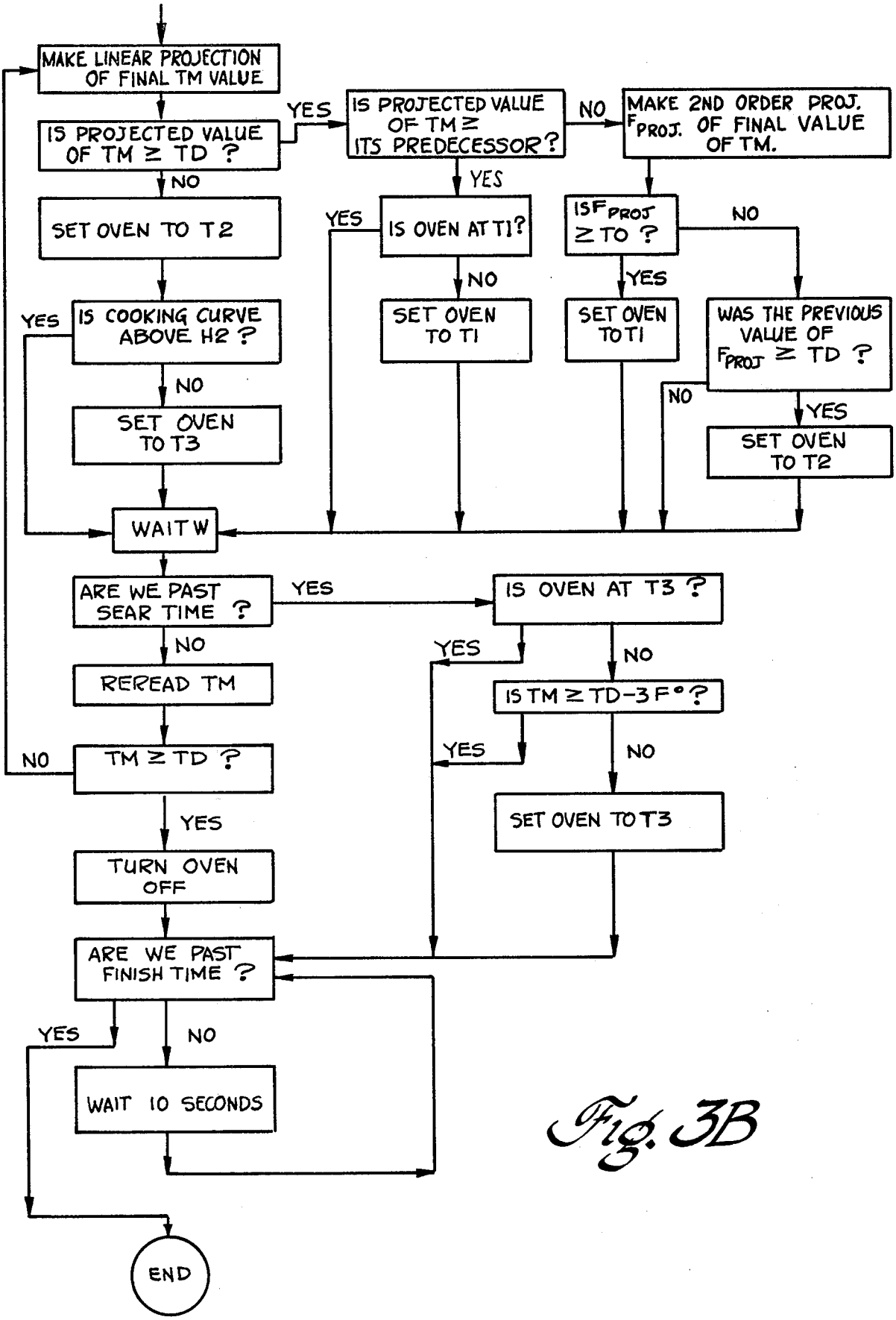

A detailed description of a preferred version of the process of the invention, illustrated in the flow chart of FIG. 3, follows.

The type and weight of the meat, the final internal temperature of the meat corresponding to the desired degree of doneness, and the desired finishing time are used to determine the required cooking time and the time at which cooking should start. (Alternatively, the starting time can be selected by the cook and the finishing time computed). From these figures the time and temperature corresponding to point E, and lines H1 and H2, can be computed in accordance with their above definitions. It should be reiterated that the temperature difference between point E and the done temperature will itself depend on the done temperature, varying from 35° F. to 45° F. The data needed to perform these steps, viz. the internal temperatures corresponding to different degrees of doneness and the proper cooking times for roasts of different sizes and meats, can be summarized in tables (see Table 1 of the Appendix). It may be especially convenient, as will be described below, to express cooking times for different meats as percentages of the cooking time of a roast of beef of the same size.

Cooking begins with the oven turned to the intermediate (T2) of the three temperatures (T1, T2, T3) at which it will be used with a given type of meat. (Hereinafter beef will be used as an example, the three oven temperatures for which may conveniently, but need not, be 200° F., 325° F. and 375° F.) The initial temperature of the interior of the meat is read, for example by means of a meat probe thermometer. (The internal meat temperature will hereinafter be designated Tm.) This is reread at short intervals and the readings compared to the original internal temperature. When Tm has risen 20° F. above its original value, the meat is considered to have entered the second, or linear, phase of cooking.

From the onset of the linear phase, Tm is measured periodically. The interval V between readings is preferably a number of minutes equal to the weight of the meat in pounds plus two, so that Tm is checked reasonably but not unnecessarily frequently. These measurements continue until the time corresponding to point E is reached or until Tm becomes greater than the ordinate of line H1 corresponding to the time of the reading. If the cooking curve does cross H1, the oven temperature can be turned down to its lowest setting T1, and the meat will "coast" to approximately the desired done temperature at approximately the correct time (H1, as noted above, is designed to make this the case). Accordingly, in this case the oven is turned down to T1, where it is held until 70% of the cooking time has elapsed.

Until either the E-point time is reached or line H1 is crossed, Tm is periodically measured, and a linear projection of the value Tm will have at the E-point time is made after each new reading of Tm. Each linear projection is made according to the equation $$T_{lin\ proj} = TM2 + [(Tm2 - Tm1) \times (\text{E-point time} - \text{Now})/(W+1)] \quad (1)$$

where $T_{lin\ proj}$ is the projected temperature, Tm2 is the last reading of Tm, Tm1 is the preceding reading of Tm, "Now" is the time of the latest Tm reading, and W is the interval in minutes between consecutive readings of Tm. As explained above, the ideal cooking curve passes through point E. Because of this, and because it is preferable in this phase to cook too fast rather than too slow (the cooking can be slowed down nearly to a halt in the end phase but cannot be accelerated beyond a certain point), if the projected temperature is not greater than the temperature corresponding to point E, the oven temperature is turned to the maximum setting T3, 375° F. in the case of beef, unless it is already at T3. If the projected temperature is greater than the E-point temperature, the meat is cooking too fast. The oven will be turned to T2 in this case if it is at its highest setting T3. Since, as stated above, it is preferable to cook too fast rather than too slow, the oven temperature will be lowered to T2 only if two consecutive linear projections are low.

When the E-point time is reached, Tm is measured twice more, at the interval W used in the linear phase between readings. These two new readings are used to make a linear projection of the final meat temperature. This projection follows the equation given above in connection with the linear projection of the linear phase, with E-point time replaced by the finish time. The projected final temperature is compared to the desired done temperature (TD hereinafter). The next portion of the process can be any one of several sequences.

First, if the projected temperature is less than than or equal to TD, the oven temperature is set at T2, if it is not already there. Then the actual temperature of the meat Tm is compared to the ordinate of line H2 for the time of the reading of Tm. If the cooking curve is above line H2, then this portion of the process is complete. If on the other hand the cooking curve is not above line H2, the oven setting is turned up to the maximum setting T3, and this portion is complete.

If the projected final temperature is greater than TD, this is an indication that the cooking is proceeding too fast, and the oven temperature is turned down to its lowest setting T1, if it is not already there.

If the projected final temperature does exceed TD, but does not exceed the preceding projection, a second order projection of the final temperature Fproj is made according to the equation:

$$\text{Fproj} = \text{Nproj} - [((\text{Done time} - \text{Now})/W) \times (\text{Oproj} - \text{Nproj})] \quad (2)$$

Nproj is the most recent linear projection of the final temperature and Oproj is the preceding linear approximation thereof. If this second order approximation is at least as great as TD, then the oven temperature is turned down to its minimum setting T1 and this sequence is complete. If the second order approximation is less than or equal to TD, however, this is an indication that the cooking process is proceeding too slowly, and the oven temperature is accordingly set at its intermediate value T2, 325° F. in the case of beef. The oven temperature is moved to T2, however, only if this is the second time in a row that a second order approximation of the final temperature has been made and found to be less than TD. At this point, this portion of the procedure is complete.

At the conclusion of the portion of the procedure beginning with the comparison of the linear projection of the final meat temperature Tm with TD and described in the preceding paragraphs, and after a further interval W the time is checked to determine whether sear time has been reached. (As explained above, sear time is the beginning of a period at the very end of the cooking process intended to permit the exterior of the roast to be seared just prior to completion.)

If the sear time has not been reached, as described above, the meat temperature Tm is reread and compared to TD. If Tm has reached TD, the oven is turned off, as the cooking is done; otherwise a new linear projection of the final temperature is prepared, using the most recent value of Tm When the sear time is reached, then the oven is raised to its highest setting T3 if it is not already there, provided that TM is at least 3° F. below TD. This results in the searing of the exterior of the roast for the last few minutes before the done time is reached.

Although the procedure described above can be carried out in any way desired, the preferred method of implementation employs a programmed microprocessor to control the thermal oven. The appropriate function code, along with the estimated weight of the roast and either the time at which the roast is to be done or the time the cook desires the cooking process to start, are all inputs provided to the microprocessor by the cook. FIGS. 4A–4F illustrate a flow chart showing the manner of implementation of the present invention by means of such a microprocessor controlled oven.

The oven is provided with a number of function word inputs, such as on, off, auto-roast, normal, etc. In step A1 (FIG. 4A), the microprocessor reads the function word to determine whether it is auto-roast or not (A2). If not, it waits ten seconds (A3) and then reads the function word again. When it reads the function word auto-roast, it reads the stop time which is input by the cook. At this point, two sequences of steps can occur, depending on whether the start time or the stop time has been input. The microprocessor checks to see whether a stop time has been input (A5). If it has been input, the microprocessor reads the estimated meat weight and reads the 3-digit code (described below) indicating the desired final temperature (B1). The microprocessor then computes the cook time and sets the cook time (CD1). The start time, which is equal to the done time minus the cooking time, is then calculated along with the E-point time and temperature (CD3,E). If, however, the microprocessor does not determine that a stop time has been input (A5), it reads the start time (A6) and sets it (B2). It then reads the meat weight and the 3-digit code (B1), and computes and sets the cook time (CD1) and calculates the down time, which is equal to the start time plus the cooked time (CD2). It then calculates the time and temperature corresponding to point E (step E).

After calculating the E point time and temperature, the microprocessor sets the stop time or the start time (FIG. 4B), as the case may be, and displays the start time, the done time and the meat temperature for the cook to see (EF). At ten second intervals, the microprocessor checks to determine whether it is yet the start time (G1). When start time is reached, the oven is set to an intermediate temperature (MID TEMP), e.g. 325° F. in the case of beef, and the meat temperature is read (H1). The most recent reading of the meat temperature is then stored, and the temperature is read again (H2). If the new temperature is not 20° F. more than the old temperature (I1), then after a one minute waiting period (I2), a new rending is taken (H2). When the new temperature finally rises 20° F. above the original temperature, the microprocessor computes W, which is a number of minutes equal to the weight of the meat in pounds plus the two (J). The variable N Temp, which is equal to the current temperature of the meat, is set (K1). The variable O Temp is set equal to N Temp (K2), and after waiting one time period W (L1), the time is read (L2). The microprocessor checks to determine whether we are past the time corresponding to point E (L3) (See FIG. 4C). If so, the microprocessor goes immediately to step P (described below). If not, it checks to determine whether the cooking curve is above the line H1 (M1). If so, the oven temperature is set to its lowest setting (LO TEMP., e.g. 200° F. (M2), and nothing more is done until the time corresponding-to point E has been reached (M3), at which time the microprocessor goes directly to step P.

If the microprocessor determines that the cooking curve has not crossed line H1, it makes the linear projection from the current time to the E-point time in accordance with equation (1), supra, (N1), and compares the projection with the E-point temperature. If the projection is less than or equal to the E-point temperature, the oven is turned up to its highest setting (e.g. 375° F.) (N3), and the microprocessor returns to step K1. If the linear projection is greater than the E-point temperature, the microprocessor checks to determine whether the oven is set at the highest temperature (HI TEMP) of 375° F. (01). If not, it returns to step K1. If the oven is at its highest setting, the microprocessor determines whether the most recent linear projection is the second consecutive linear projection greater than the E-point temperature (02). If so, it sets the oven temperature to its intermediate (MID TEMP) value of e.g. 325° F. (04), and proceeds to step K1. If not, this linear projection is counted (03), so that when the next linear projection is made the microprocessor will be able to determine whether it is the second consecutive high projection. Then the microprocessor goes back to step K1 (FIG. 4B).

When step P (FIG. 4D) is reached as described above, we are beginning the final phase. At this point, it is necessary to reinitialize the count register which is used to count the number of consecutive linear approximations made using equation (2), and to place the current temperature into the 0 temp register (P). After one timed period W (Q1), the temperature of the meat is reread and stored in the N Temp register and the time is read (Q2). A linear projection is then made of the final temperature, in accordance with equation (2), supra, (R1). The projected final temperature is then compared to the desired done temperature TD (R2). If the current linear projection is greater than TD, then the current linear projection is compared to its predecessor (T1). If the earlier projection is greater than the current linear projection, then the microprocessor proceeds to step U1 (described below). If the current linear projection is at least as great as its predecessor, then the microprocessor checks to see whether the oven is at its lowest (LO TEMP.) setting (e.g. 200° F.) (V1). If it is, the 0 Temp register is set to the value previously contained in the N Temp resister, and similarly, the register Oproj is given the value of the Nproj register, which contains the value of the most recent linear projection of the final temperature (W). If the microprocessor has discovered in step V1 that the oven is not set at its lowest setting, the oven is then set to that temperature (T2), after which registered 0 Temp and Oproj are reset as described above (W). If in step R2, the linear projection is found not to be greater than TD, then the oven temperature is set to its middle (MID TEMP.) setting (e.g. 325° F.) (R3), and the microprocessor checks to determine whether the cooking curve is above line H2 (V2). If it has, we go directly to step W; if not, then the oven temperature is set to its highest setting (e.g 375° F.) (V3), and then we go to step W.

Figure 4C:
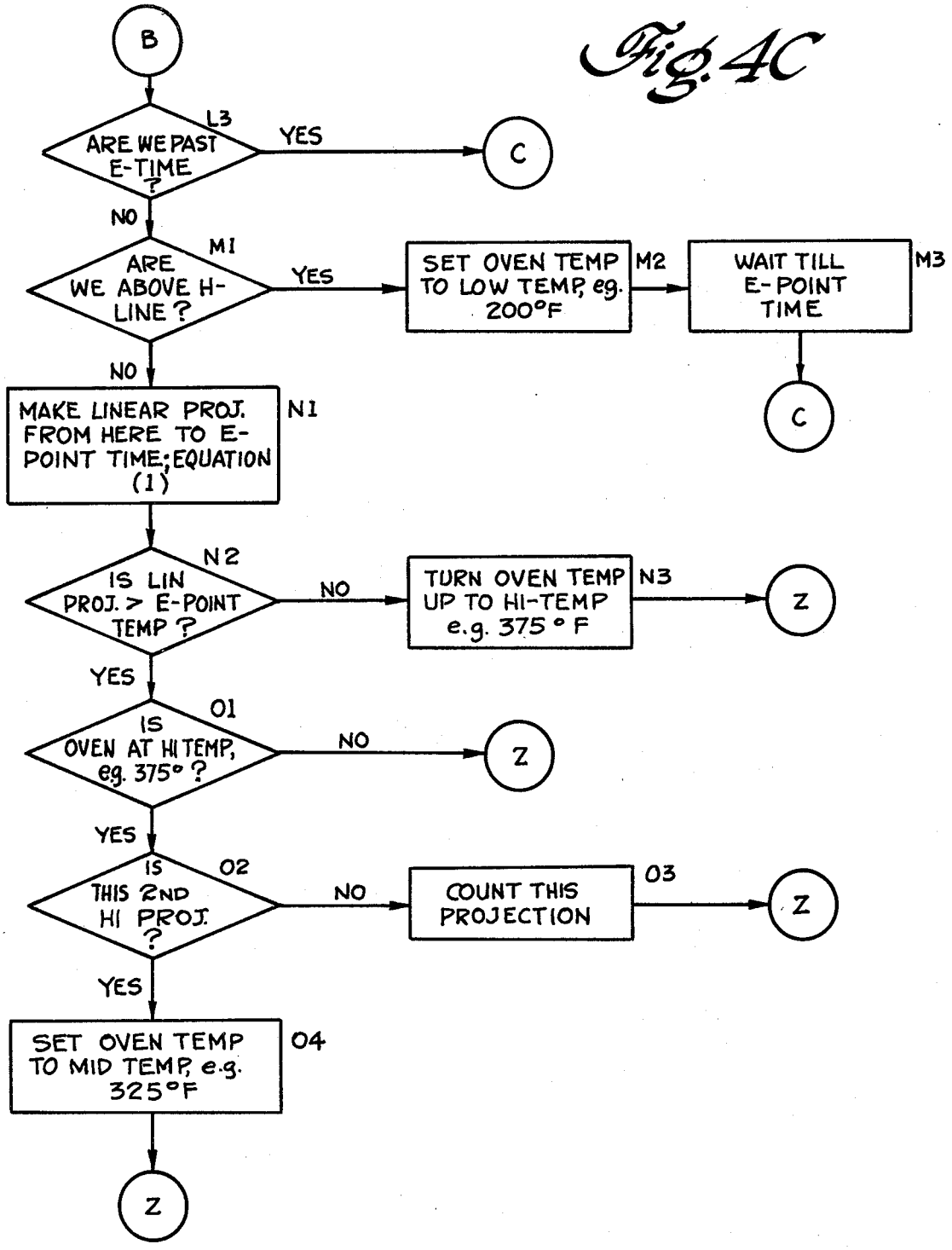
Figure 4D:
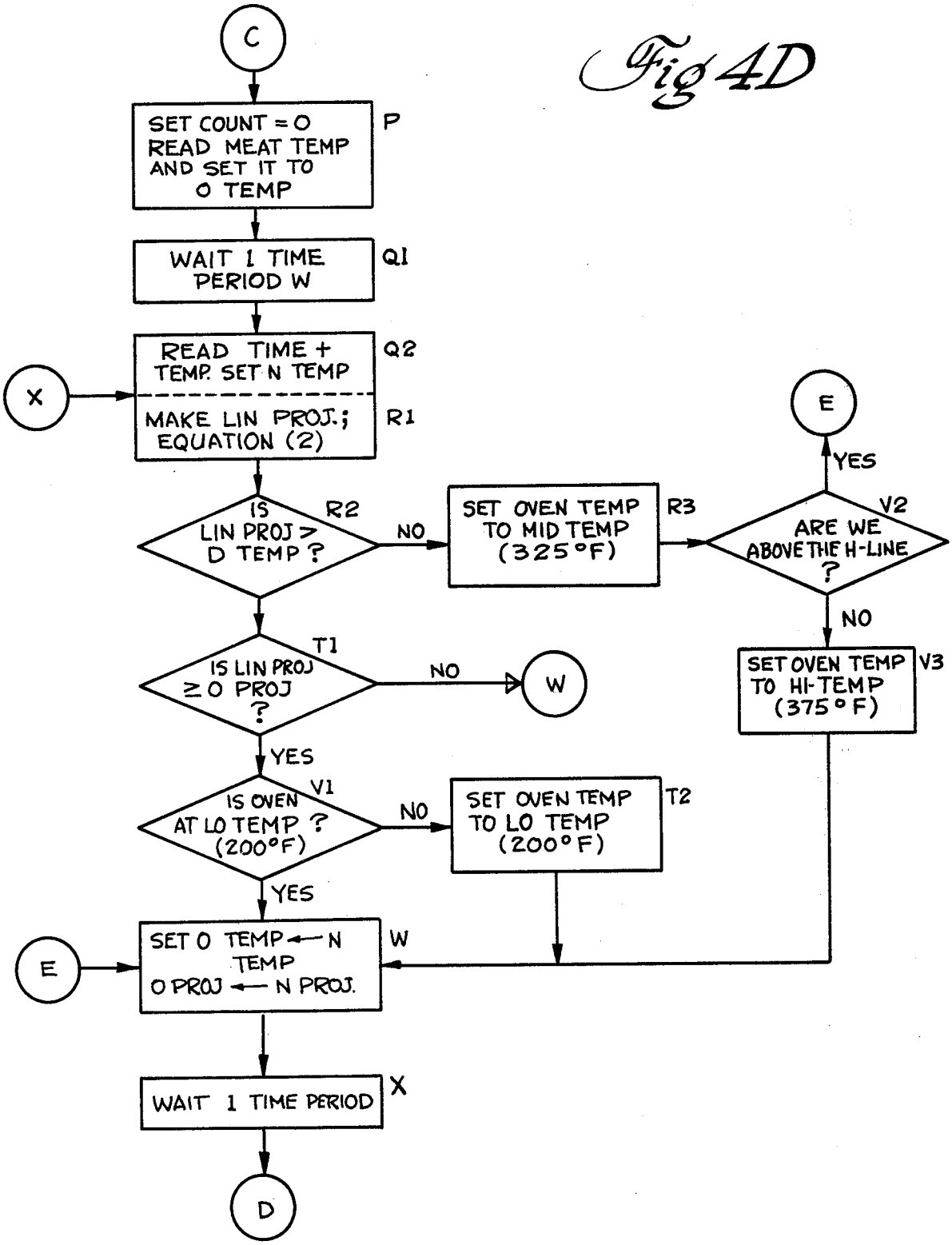

As described above, if Oproj is found to be greater than the most recent linear projection in step T1, the microprocessor goes to step U1 (FIG. 4F), in which the second order approximation of the done temperature is made in accordance with equation (3), supra, and is compared to TD. If the second order projection Fproj is greater than or equal to TD, the oven temperature is set to its lowest setting and the count is set to zero (U3), and we go to step W (FIG. 4D). If the second order projection is less than TD, then the microprocessor checks to determine whether this is the second consecutive second order projection less than TD (U2). If it is, the oven temperature is set to its intermediate setting (U4), and we go to step W. If this is not the second consecutive low second order projection, this projection is counted (U5), so that the microprocessor will be able to determine whether the next second order approximation is the second consecutive low one or not. From step U5 we go, again, to step W.

Figure 4E:
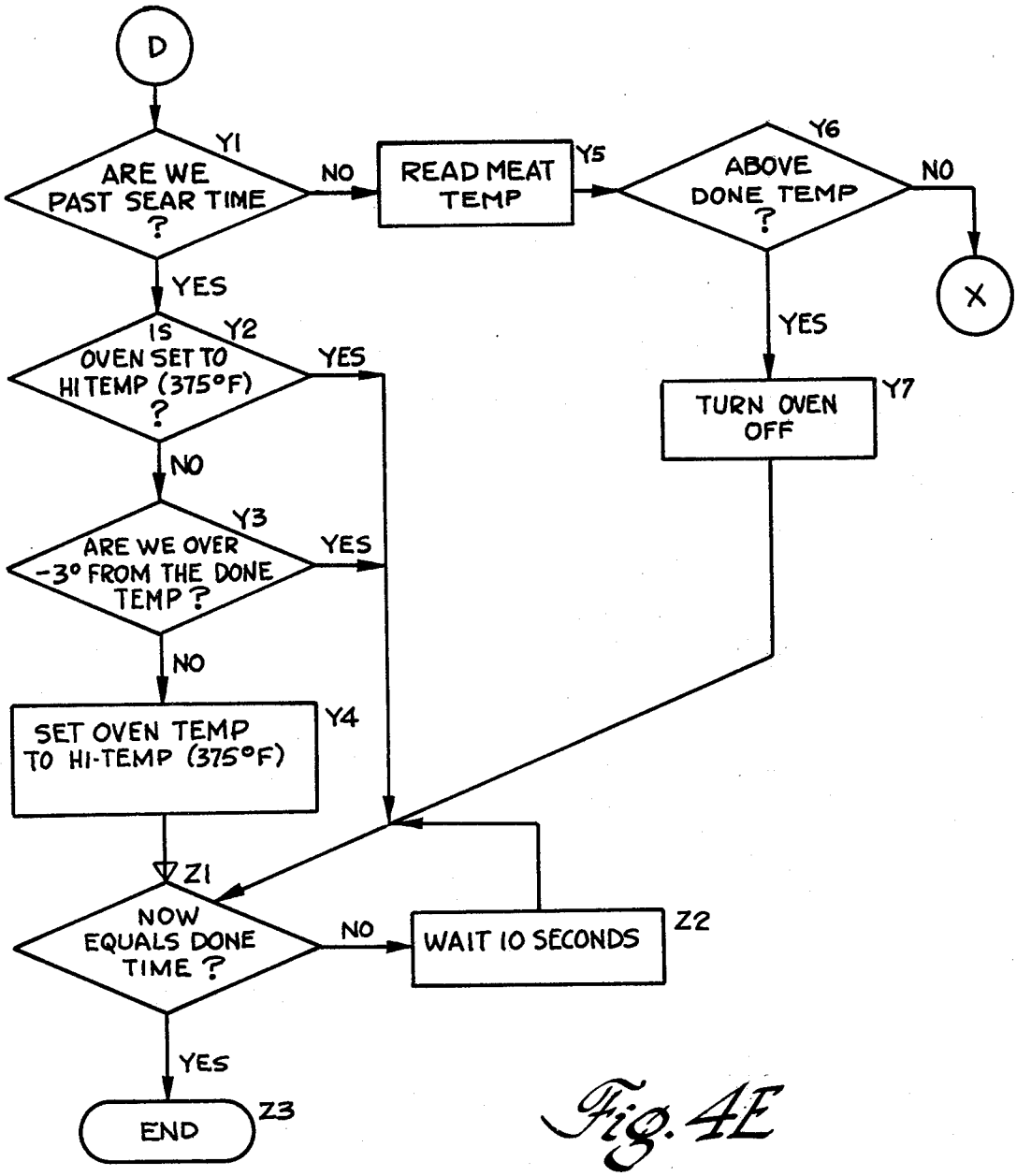
Figure 4F:
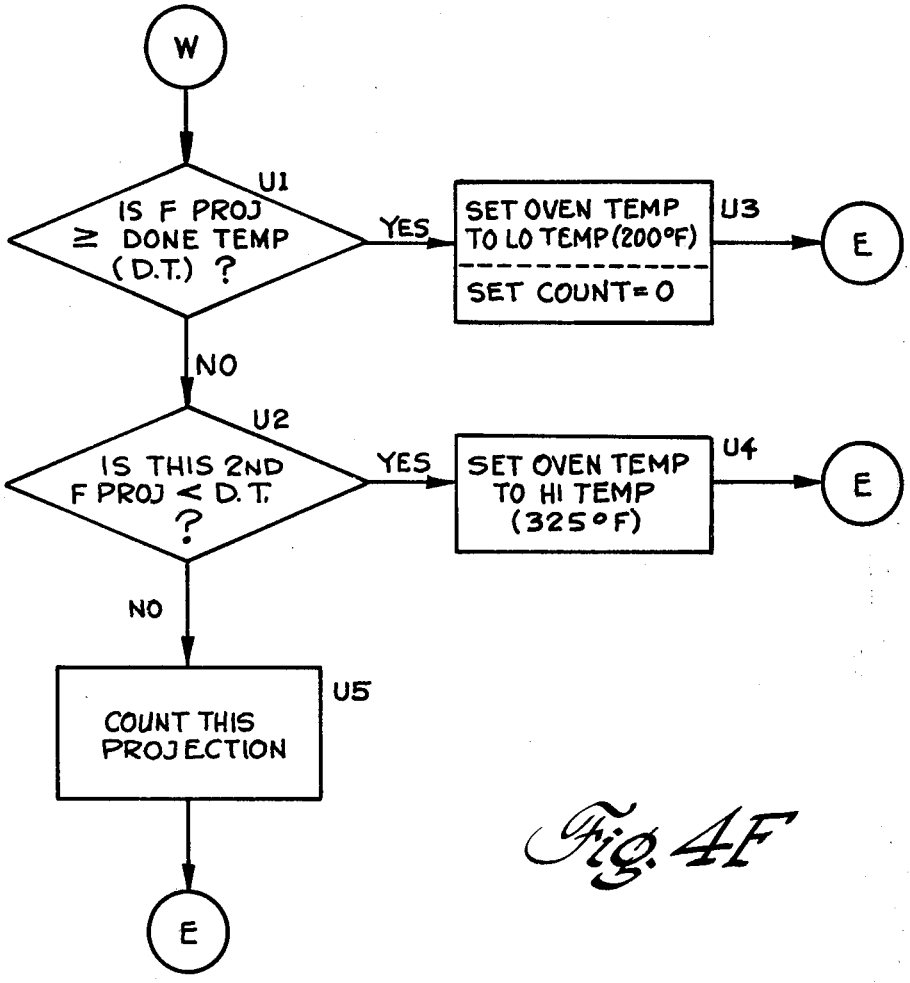

From step W, in which the O Temp and Oproj registers are reset, after waiting one timed period W (X), the microprocessor checks to determine whether we are past sear time or not (Y1) (see FIG. 4E). If so, the oven is checked to determine whether it is set to its highest level (Y2). If it is, the microprocessor proceeds to step Z1 (described below). If the oven is not at its highest setting, the microprocessor checks to determine whether the meat temperature is at least as high as TD-3° F. (Y3). If it is, we proceed directly to step Z1. If not, the oven temperature is set up to its highest setting (Y4), after which the microprocessor checks to determine whether done time has been reached (Z1). If it is, the cooking process is ended (Z3). If not, the microprocessor waits ten seconds (Z2) and checks the time again (Z1). If the microprocessor determines in step Y1 that sear time has not been reached, then it reads meat temperature (Y5) and compares it to the done temperature TD (Y6). If the meat temperature is above the done temperature, the oven is turned off (Y7) and the microprocessor goes to step Z1 (described above). If the done temperature has not been reached, the microprocessor returns to step Q2 to begin the process of making another linear approximation.

When carrying out the foregoing procedure, the user positions a meat probe thermometer approximately in the center of the roast, and inputs the necessary data, namely the type and weight of the meat, the desired final temperature of the meat, and the desired done time. When doing so, it is preferable to input the cooking time percentage and the desired final temperature using a 3-digit code. The user inputs a 3-digit number: the first digit indicates the cooking time for the type of meat presently being cooked, expressed as a percentage of the cooking time that would be required for a rolled rib beef roast of the same weight, while the last two digits indicate the desired final temperature. The cooking time percentage is indicated as follows: Zero indicates that the cooking time should be the same as that for beef, 1 indicates ninety percent as long as for a beef roast of the same weight, 2 indicates eighty percent, etc. For various types of meat, the digits 0–5 will suffice, while digits 6–9 will be suitable for use with poultry. The last two digits of the code are the last two digits of the desired final temperature in Fahrenheit degrees, the first digit of which is assumed to be 1. It has been found that this simple and convenient 3-digit code significantly simplifies and reduces the expense of the electronic circuitry required to implement the invention.

Although one preferred embodiment of the method of the present invention has been described in detail above, this is given by way of example only, and accordingly, the scope of the present invention is to be limited not by the details of the foregoing description but only by the terms of the appended claims.

APPENDIX

TABLE 1

| Type of Meat | % Cook Time | Code | Temp. Range |
|---|---|---|---|
| BEEF | | | |
| Rolled Rib (Boneless) | 100 | 0 | 125–165 |
| Standing Rib (Bone-In) | 80 | 2 | 125–165 |
| VEAL | | | |
| Rolled Rib (Boneless) | 100 | 0 | 125–165 |
| Standing Rib (Bone-In) | 80 | 2 | 125–165 |
| PORK | | | |
| Boston Butt, Shoulder, Fresh Ham (Boneless), Center Loin | 80 | 2 | 165–185 |
| Center Loin, Fresh Ham, Shoulder (Bone-In) | 70 | 3 | 165–185 |
| LAMB | | | |
| All types (Boneless) | 70 | 3 | 135–165 |
| All types (Bone-In) | 60 | 4 | 135–165 |

Column 2 gives the cooking time for the meat of column 1 as a percentage of the cooking time for a boneless rolled rib roast.

Column 3 gives the code digit containing the cooking time, as explained supra.

Column 4 gives the range of internal temperatures appropriate for use as target temperatures for the meats of column 1.

What is claimed is:

1. A method for automatically cooking meat or poultry with a thermal oven to a desired degree of doneness by a selected time, comprising the steps of:

(a) measuring, at predetermined intervals, the elapsed time since cooking has begun;

(b) measuring, at at least two values of elapsed cooking time, the temperature of the meat or poultry being cooked;

(c) using the at least two measurements of temperature and the associated cooking time values obtained in step (b) to project what the temperature of the meat or poultry will be at a later time, which later time is earlier than said selected time;

(d) comparing the projected temperature obtained in step (c) with a standard temperature, said standard temperature being essentially the temperature said material should have at said later time in order to finish cooking at said selected time with said desired degree of doneness; and (e) modifying the temperature of said thermal oven as a function of the result of the step (d) comparison of said projected temperature and said standard temperature to modify the rate at which said meat or poultry is cooking.

2. The method of claim 1, wherein step (b) includes the steps of: making at least two measurements of said temperature of said meat or poultry during a second phase, after a first phase, of cooking and during which second phase said temperature of said meat or poultry rises approximately linearly with time; and measuring the temperature of said meat or poultry being cooked during the first phase of cooking to determine when the second phase commences, the first phase terminating when the temperature of said meat or poultry has risen a predetermined amount over the temperature thereof at the commencement of elapsed time, when said meat or poultry begins to be heated in said thermal oven.

3. The method of claim 2, wherein said predetermined amount is 20° F.

4. The method of claim 2, wherein said projected temperature of step (c) is a linear projection of the at least two temperature measurements of step (b).

5. The method of claim 2, further comprising the steps of:

(f) defining a mathematical relation between said temperature of said meat or poultry and the cooking time elapsed during said second phase, said relation being such that if, any time during said second phase, the temperature of said meat or poultry measured at any one of the at least two measurements of step (b) is at least the value of said relation corresponding to the time of the associated temperature measurement, then said meat or poultry will cook to approximately said desired degree of doneness at said selected time if the temperature of said thermal oven is, at said any time during said second phase, turned down to a first, minimum setting;

(g) comparing each step (b) measurement of said temperature of said meat or poultry to the value of the step (f) relation corresponding to the associated step (a) time at which said step (b) measurement is made; and (h) lowering said temperature of said thermal oven to said first setting when said comparing step (g) indicates that said actual temperature of said meat or poultry is at least equal to said corresponding value of said step (f) relation.

6. The method of claim 5 wherein said first setting of said thermal oven is approximately 200° F.

7. The method of claim 5, wherein said process of cooking said meat or poultry further includes a third phase subsequent to said second phase, the following steps being performed during said third phase:

(i) determining the rate at which said temperature of said meat or poultry increases with time;

(j) determining the decreasing rate of change, with time, of the rate of step (i);

(k) estimating, by use of the decreasing rate of change obtained in step (j), the temperature said meat or poultry will have at said selected time;

(l) determining whether the final temperature of said meat or poultry estimated in step (k) is such that said meat or poultry will reach said desired degree of doneness by said selected time; and (m) setting said thermal oven at least at a second temperature setting, higher than said first setting, if said step (l) determination of estimated final temperature is not such that said meat or poultry will reach said desired degree of doneness by said selected time.

8. The method of claim 7, wherein said second setting is approximately 325° F.

9. The method of claim 7, further comprising the following steps performed during said third phase:

(n) determining, after completion of step (m), the rate at which said temperature of said meat or poultry is increasing with time;

(o) determining whether said step (m) rate is sufficient to allow said meat or poultry to reach said desired degree of doneness by said selected time; and (p) setting said thermal oven to a third temperature setting, higher than said second setting, if step (o) determines that the step (n) rate is too low to allow said meat or poultry to reach said desired degree of doneness by said selected time.

10. The method of claim 9, wherein said third setting is 375° F.

11. The method of claim 9, wherein said third setting is the highest temperature setting of said thermal oven used in said method when meat is being cooked.

12. The method of claim 9, wherein said third temperature setting step (p) further comprises the steps of:

(g) making a further determination, at a preselected time interval after completion of step (o), of the rate at which the temperature of the meat or poultry is increasing with time;

(r) setting said thermal oven to said third temperature only if the respective values of said rate obtained by both step (o) and step (g) determinations indicate that said rate is too low to allow said meat or poultry to reach said desired degree of doneness by said preselected time.

13. The method of claim 1, wherein the steps of said method are controlled by an automatic control means, and said method further comprises the initial step of inputting in coded form the cooking time and said desired degree of doneness into said control means.

14. The method of claim 13, wherein said inputting step is performed using a three-digit code whose first digit n denotes the cooking time by the formula $t=(100\%-n\times 10\%)B$, where t is the cooking time in minutes, and B the cooking time in minutes of a boneless piece of beef of the same weight as said meat or poultry being cooked, and whose second and third digits are the 2nd and 3rd digits, respectively, of the temperature in Fahrenheit degrees said meat or poultry is desired to have when it is done, said desired temperature being between 100° F. and 199° F., inclusive.

15. The method of claim 1, wherein said temperature of said material is the temperature of the interior thereof.

16. The method of claim 15, wherein said temperature is measured by means of a thermal meat probe thermometer means.

17. A method for automatically cooking meat or poultry with a thermal oven to a desired degree of doneness by a selected time, comprising the steps of:

(A) raising, at an initial time, the temperature setting of said oven to a first predetermined value;

(B) maintaining said temperature setting at said first value until the internal temperature of said meat or poultry rises from an initial level to a first novel above said initial level, said first level defining the beginning of a linear period during which the temperature of said meat or poultry rises in a substantially linear manner with time;

(C) periodically measuring the temperature of said meat or poultry during said linear period, said linear period ending at a time which is a predetermined portion of the interval between said initial and selected times, and being the time when the temperature of said meat or poultry should have risen to a second level which is a predetermined number of degrees below a desired final temperature of said meat or poultry which corresponds to said desired degree of doneness;

(D) periodically linearly projecting, for each pair of temperature measurements and associated measurement times of step C, and as a linear function of the last two of said periodic measurements, what the temperature of said meat or poultry will be at the ending time of said linear period;

(E) raising the temperature setting of said oven during said linear period to a second predetermined value, which is higher than said first predetermined value, whenever said projected temperature is lower than said second level; and (F) lowering the temperature setting of said oven during said linear period to a third predetermined value, which is lower than said first predetermined value, and maintaining said temperature setting of said oven at said third predetermined value during the remainder of said linear period, whenever one of said periodic measurements of the temperature of said meat or poultry is at least equal to a temperature determined by a mathematical relationship between said temperature of said meat or poultry and cooking time elapsed during said linear period, said relationship being such that if at any time during said linear period the measured temperature of said meat or poultry is at least the value of said relationship corresponding to the time of said measurement, then said meat or poultry will cook to approximately said desired final temperature by said selected time if said temperature setting of said oven is reduced to said third predetermined value; and (G) adjusting said temperature setting between said first, second and third levels during a final period, after the end of said linear period, such that said meat or poultry reaches said desired final temperature at said selected time.

* * * * *